US011663950B2

(12) United States Patent
Park et al.

(10) Patent No.: US 11,663,950 B2
(45) Date of Patent: May 30, 2023

(54) DISPLAY APPARATUS AND DRIVING METHOD THEREOF

(71) Applicant: Samsung Display Co., Ltd., Yongin-Si (KR)

(72) Inventors: Se Hyuk Park, Seongnam-si (KR); Hong Soo Kim, Hwaseong-si (KR); Jin Young Roh, Hwaseong-si (KR); Hyo Jin Lee, Seongnam-si (KR); Jae Keun Lim, Suwon-si (KR)

(73) Assignee: Samsung Display Co., Ltd., Yongin-Si (KR)

( * ) Notice: Subject to any disclaimer, the term of this patent is extended or adjusted under 35 U.S.C. 154(b) by 13 days.

(21) Appl. No.: 17/319,758

(22) Filed: May 13, 2021

(65) Prior Publication Data

US 2022/0051602 A1 Feb. 17, 2022

(30) Foreign Application Priority Data

Aug. 11, 2020 (KR) ..... 10-2020-0100735

(51) Int. Cl.

| | |
|---|---|
| ***G09G 3/20*** | (2006.01) |
| ***G09G 3/3275*** | (2016.01) |
| ***G09G 5/06*** | (2006.01) |

(52) U.S. Cl.

CPC ..... *G09G 3/2003* (2013.01); *G09G 3/3275* (2013.01); *G09G 5/06* (2013.01); *G09G 2310/027* (2013.01); *G09G 2320/0247* (2013.01)

(58) Field of Classification Search

CPC ..... G09G 3/3611–3696; G09G 3/30–3291

See application file for complete search history.

(56) References Cited

U.S. PATENT DOCUMENTS

| | | | | |
|---|---|---|---|---|
| 2013/0070007 | A1* | 3/2013 | Park | G09G 3/3233 345/694 |
| 2014/0313236 | A1* | 10/2014 | Jang | G09G 3/3648 345/690 |
| 2016/0284257 | A1* | 9/2016 | Choi | G09G 3/3688 |
| 2020/0051492 | A1* | 2/2020 | Chen | G09G 3/20 |
| 2020/0111418 | A1* | 4/2020 | Nam | G09G 3/3266 |
| 2020/0143749 | A1* | 5/2020 | Kim | G09G 3/3275 |
| 2021/0201798 | A1* | 7/2021 | Kim | G09G 3/3233 |

FOREIGN PATENT DOCUMENTS

| | | | |
|---|---|---|---|
| KR | 10-2011-0045643 | A | 5/2011 |
| KR | 10-2013-0118459 | A | 10/2013 |
| KR | 10-2015-0049923 | A | 5/2015 |
| KR | 10-1544843 | B1 | 8/2015 |
| KR | 10-2059501 | B1 | 12/2019 |

* cited by examiner

*Primary Examiner* — Roy P Rabindranath

(74) *Attorney, Agent, or Firm* — Innovation Counsel LLP

(57) ABSTRACT

A display device includes: a display panel configured to display an image; a signal controller configured to determine whether an input image signal is a still image signal, and determine color coordinates using data values of one frame data of the input image signal, and generate compensated image data by compensating image data of the one frame data based on the color coordinates; and a data driver configured to generate a data signal based on the compensated image data and output the compensated image data to the display panel through a data line.

14 Claims, 8 Drawing Sheets

FIG. 5

| Grays | Optimal Flicker color coordinates | LUT |
|---|---|---|
| 255 | 0.299, 0.312 | 1 |
| 247 | 0.299, 0.312 | 1 |
| 239 | 0.299, 0.312 | 1 |
| 231 | 0.299, 0.312 | 1 |
| 223 | 0.299, 0.312 | 1 |
| 215 | 0.299, 0.312 | 1 |
| 207 | 0.299, 0.312 | 1 |
| 199 | 0.299, 0.312 | 1 |
| 191 | 0.299, 0.312 | 1 |
| 183 | 0.305, 0.321 | 0 |
| 175 | 0.305, 0.321 | 0 |
| 167 | 0.305, 0.321 | 0 |
| 159 | 0.305, 0.321 | 0 |
| 151 | 0.305, 0.321 | 0 |
| 143 | 0.305, 0.321 | 0 |
| 135 | 0.305, 0.321 | 0 |
| 127 | 0.305, 0.321 | 0 |
| 119 | 0.312, 0.331 | 2 |
| 111 | 0.312, 0.331 | 2 |
| 103 | 0.312, 0.331 | 2 |
| 95 | 0.312, 0.331 | 2 |
| 87 | 0.312, 0.331 | 2 |
| 79 | 0.312, 0.312 | 3 |
| 71 | 0.312, 0.312 | 3 |
| 63 | 0.312, 0.312 | 3 |
| 55 | 0.312, 0.312 | 3 |
| 47 | 0.312, 0.312 | 3 |
| 39 | 0.299, 0.331 | 4 |
| 31 | 0.299, 0.331 | 4 |
| 23 | 0.299, 0.331 | 4 |
| 15 | 0.299, 0.331 | 4 |
| 7 | 0.299, 0.331 | 4 |
| 0 | 0.299, 0.331 | 4 |

DISPLAY APPARATUS AND DRIVING METHOD THEREOF

CROSS-REFERENCE TO RELATED APPLICATION

This application claims priority to and benefits of Korean Patent Application No. 10-2020-0100735, filed in the Korean Intellectual Property Office on Aug. 11, 2020, the disclosure of which is incorporated herein by reference in its entirety.

BACKGROUND

(a) Field

The present disclosure relates to a display device and a driving method thereof.

(b) Description of the Related Art

Research is being conducted to optimize battery consumption of various electronic devices that are widely used in our lives, such as smartphones, laptop computers, and tablet personal computers (PCs).

Many electronic devices may include a display panel. Battery consumption of the electronic device may be optimized by minimizing power consumption of the display panel. For example, the display panel may be driven in a low frequency driving mode to reduce its power consumption.

When the display panel is driven in the low frequency driving mode, one frame period may be increased thereby increasing a leakage current in a pixel, and this leakage current may cause a difference in luminance of the pixel between two subsequent frames, causing a flickering phenomenon.

The above information disclosed in this background section is only for enhancement of understanding of the present disclosure, and it may contain information that may not form a prior art that is already known to a person of ordinary skill in the art.

SUMMARY

The present disclosure provides a display device that is capable of preventing a flicker phenomenon that may occur during low frequency driving and a method of driving the display device.

The display device may be driven at various driving frequencies and is capable of providing improved display quality.

According to an embodiment of the present disclosure, a display device includes: a display panel including a plurality of pixels and configured to display an image; a signal controller configured to determine whether an input image signal is a still image signal, determine color coordinates using data values of one frame data of the input image signal, and generate compensated image data by compensating image data of the one frame data based on the color coordinates; and a data driver configured to generate a data signal based on the compensated image data and output the compensated image data to the display panel through a data line.

The signal controller may include an image determiner that is configured to compare at least two frame data of the input image signal to determine whether the input image signal is the still image signal.

The image determiner may determine a driving frequency at which one frame data is displayed based on determination that the input image signal is the still image signal.

The image determiner may calculate at least one of a first representative gray value for each pixel, a second representative gray value for each area, and a third representative gray value of an image, using gray values of the plurality of pixels in the one frame data based on determination that the input image signal is the still image signal.

The signal controller may further include an image compensator that is configured to generate the compensated image data based on at least one of the driving frequency, the first representative gray value for each pixel, the second representative gray value for the area, and the third representative gray value of the image.

The image compensator may compensate the image data depending on the one frame data using compensation data stored in a look-up table (LUT).

The driving frequency may be lower than 60 Hz.

The image determiner may receive a panel self refresh (PSR) control signal for controlling a PSR mode in which the display panel displays a still image together with the input image signal, and may determine whether the input image signal is the still image signal based on the PSR control signal.

Each of the plurality of pixels may include: a first transistor connected to the data line providing the data signal based on a scan signal received through a scan line; a capacitor connected to the first transistor and configured to store a voltage corresponding to the data signal; and a second transistor providing a driving current based on the voltage.

According to another embodiment of the present disclosure, a driving method of a display device includes: determining whether an input image signal is a still image signal; based on determination that the input image signal is the still image signal, determining color coordinates using data values of one frame data of the input image signal, and generating compensated image data by compensating image data of the one frame data based on the color coordinates; and generating a data signal based on the compensated image data and outputting the compensated image data to a display panel through a data line.

The determining whether the input image signal is the still image signal may include comparing at least two frame data of the input image signal to determine whether the input image signal is the still image signal.

The method may further include determining a driving frequency at which the one frame data is displayed based on determination that the input image signal is the still image signal.

The method may further include calculating at least one of a first representative gray value for each pixel of a plurality of pixels, a second representative gray value for each area, and a third representative gray value of an image, using gray values of the plurality of pixels in the one frame data based on determination that the input image signal is the still image signal.

The method may further include generating the compensated image data based on at least one of the driving frequency, the first representative gray value for each pixel of the plurality of pixels, the second representative gray value for each area, and the third representative gray value of the image.

The compensated image data may be generated based on compensation data stored in a look-up table (LUT).

The driving frequency may be lower than 60 Hz.

The determining of whether the input image signal is the still image signal may include: receiving a panel self refresh (PSR) control signal for controlling a PSR mode displaying a still image together with the input image signal; and determining whether the input image signal is the still image signal based on the PSR control signal.

According to another embodiment of the present disclosure, a display device includes: a display panel including a pixel that includes a light emitting element that is configured to emit light according to a driving current that corresponds to a data signal applied to a data line; a signal controller configured to generate image data depending on an input image signal; and a data driver configured to generate the data signal using the image data, wherein the display panel displays an image corresponding to the input image signal at a driving frequency, and wherein voltage values of data signals corresponding to a same gray are different from each other based on the driving frequency.

The signal controller may determine whether the driving frequency is lower than 60 Hz, and compensate one frame data of the input image signal to generate the image data.

The signal controller may determine whether the frequency is lower than 60 Hz based on the input image signal being a still image signal.

The display device is capable of providing improved image quality when it is driven at a low frequency.

According to the embodiments, the display device is capable of providing an image with consistent image quality even when the display device is driven at various driving frequencies.

BRIEF DESCRIPTION OF THE DRAWINGS

FIG. 5 shows a look-up table (LUT) stored in a display device according to an embodiment.

DETAILED DESCRIPTION

Figure 1:
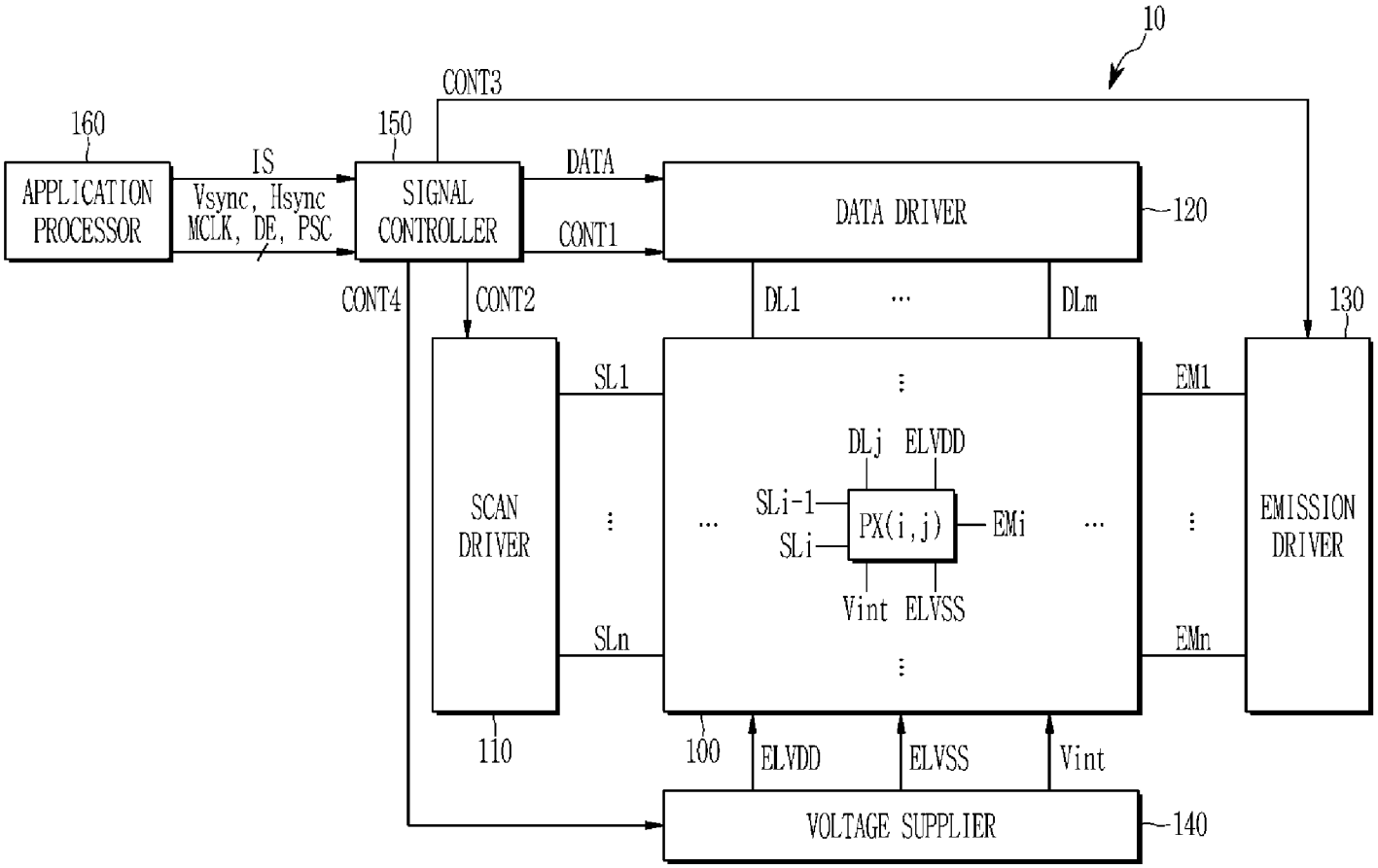
FIG. 1 illustrates a block diagram of a display device according to an embodiment.

The present disclosure will be described more fully hereinafter with reference to the accompanying drawings, in which various embodiments of the present disclosure are shown. As those skilled in the art would realize, the embodiments described herein may be modified in variously different ways, without departing from the spirit or scope of the present disclosure.

To clearly describe the present disclosure, parts that are irrelevant to the description may be omitted, and like numerals refer to like or similar constituent elements throughout the specification.

Further, sizes and thicknesses of constituent members may be arbitrarily shown in the accompanying drawings for better understanding and ease of description, but the present disclosure is not limited to the illustrated sizes and thicknesses. In the drawings, the thicknesses of layers, films, panels, regions, etc., may be exaggerated for clarity for better understanding and ease of description.

It will be understood that when an element such as a layer, film, region, or substrate is referred to as being "on" another element, it can be directly on the other element or one or more intervening elements may also be present therebetween. In contrast, when an element is referred to as being "directly on" another element, there may be no intervening elements present therebetween. Further, in the specification, the word "on" or "above" means positioned on or below the object portion, and does not necessarily mean positioned on an upper side of the object portion based on a gravitational direction.

In addition, unless explicitly described to the contrary, the word "comprise" and its variations such as "comprises" or "comprising" will be understood to imply an inclusion of stated elements but not an exclusion of any other elements.

FIG. 1 illustrates a block diagram of a display device according to an embodiment.

The display device 10 includes a display panel 100, a scan driver 110, a data driver 120, an emission driver 130, a voltage supplier 140, and a signal controller 150. In addition, the display device 10 may be connected to an application processor 160, or the display device 10 may include the application processor 160. Some of the constituent elements illustrated in FIG. 1 may not be essential for implementing the display device 10, so the display device 10 described in the present disclosure may include more or less constituent elements than the foregoing listed constituent elements.

The display 100 includes a plurality of pixels PX connected to corresponding scan lines of a plurality of scan lines SL1 to SLn, corresponding data lines of a plurality of data lines DL1 to DLm, and corresponding emission control lines of a plurality of emission control lines EM1 to EMn. Each of the pixels PX emits light corresponding to a data signal that is transferred to the corresponding pixel PX via the data lines DL1 to DLm, and the display panel 100 may display an image accordingly.

The scan lines SL1 to SLn may extend substantially in a row direction of the pixels PX to be substantially parallel to each other. The emission control lines SL1 to SLn may also extend substantially in the row direction to be substantially parallel to each other. The data lines SL1 to DLm may extend substantially in a column direction of the pixels PX to be substantially parallel to each other.

Each of the plurality of pixels PX may receive a high power supply voltage ELVDD and a low power supply voltage ELVSS and an initialization voltage Vint from the voltage supplier 140.

Herein, supply wires of an (i−1)-th scan line SL(i−1) and an i-th scan line SLi, the emission control line EMi, and the initialization voltage Vint of a pixel PX(i,j) may be disposed in the same layer, and supply wires of the data line DLi and the power supply voltages ELVDD and ELVSS of the pixel PX(i,j) may be disposed in the same layer. The supply wires of the scan lines SL(i−1) and SLi, the emission control line EMi, the initialization voltage Vint, the data line DLi, and the power supply voltages ELVDD and ELVSS may include a same material or different materials, and may be disposed in the same layer or different layers on a substrate (not shown).

The scan driver 110 is connected to the display panel 100 through the scan lines SL1 to SLn. The scan driver 110 may generate a plurality of scan signals based on a second control signal CONT2 and transfer them to a corresponding scan line among the scan lines SL1 to SLn. The second control signal CONT2 may include an operation control signal of the scan driver 110 that is generated and transferred by the signal controller 150.

The data driver 120 is connected to each pixel PX of the display panel 100 through the data lines DL1 to DLm. The data driver 120 may receive an image data signal DATA and transmit a data signal to a corresponding one of the data lines DL1 to DLm based on a first control signal CONT1. The first control signal CONT1 may include an operation control signal of the data driver 120 that is generated and transferred by the signal controller 150.

The data driver 120 may select a gray voltage based on the image data signal DATA and transfer it to the data lines DL1 to DLm as a data signal. For example, the data driver 120 may sample and hold the image data signal DATA based on the first control signal CONT1, and may transfer a plurality of data signals to the data lines DL1 to DLm. The data driver 120 may apply the data signal having a predetermined voltage level to the data lines DL1 to DLm while scan signal having a low level is applied.

The emission driver 130 may generate a plurality of emission control signals based on a third control signal CONT3. The third control signal CONT3 may include an emission start signal, an emission clock signal switching to a low level at different times, a holding control signal, and/or the like. The emission start signal may generate a first emission control signal for displaying an image of one frame. The emission clock signal included in the third control signal CONT3 may include synchronization signals for applying the emission control signal to the emission control lines EM1 to EMn. The holding control signal may control the emission driver 130 to continuously output an emission signal during low frequency driving.

The signal controller 150 may receive an external image signal IS and an input control signal that controls display of an image on the display panel 100. The image signal IS may include luminance information that is divided by gray values of each pixel PX of the display panel 100.

The input control signal that is transferred to the signal controller 150 may include a vertical synchronization signal Vsync, a horizontal synchronization signal Hsync, a main clock signal MCLK, a data enable signal DE, a panel self refresh (PSR) control signal PSC, and the like.

The signal controller 150 may generate the control signals (e.g., CONT1, CONT2, CONT3, CONT4) and the image data signal DATA based on the image signal IS, the horizontal synchronizing signal Hsync, the vertical synchronization signal Vsync, the main clock signal MCLK, the data enable signal DE, and the like.

The signal controller 150 may process the image signal IS in accordance with an operating condition of the display panel 100 and the data driver 120 based on the input image signal IS and the input control signal. Specifically, the signal controller 150 may generate the image data signal DATA through an image processing process such as gamma correction and luminance compensation on the image signal IS.

The signal controller 150 may transfer the first control signal CONT1 for controlling an operation of the data driver 120 to the data driver 120 together with the image data signal DATA that may have been processed. In addition, the signal controller 150 may transfer the second control signal CONT2 for controlling an operation of the scan driver 110 to the scan driver 110. The signal controller 150 may also transfer the third control signal CONT3 for controlling an operation of the emission driver 130 to the emission driver 130.

In addition, the signal controller 150 may control driving of the voltage supplier 140. The power supplier 140 may supply the power supply voltages ELVDD and ELVSS for driving each of the pixels PX of the display panel 100 and the initialization voltage Vint. For example, the signal controller 150 may transfer a fourth control signal CONT4 for controlling an operation of the voltage supplier 140 to the voltage supplier 140. The voltage supplier 140 may be connected to a voltage supply line that may be formed in the display panel 100.

Figure 2:
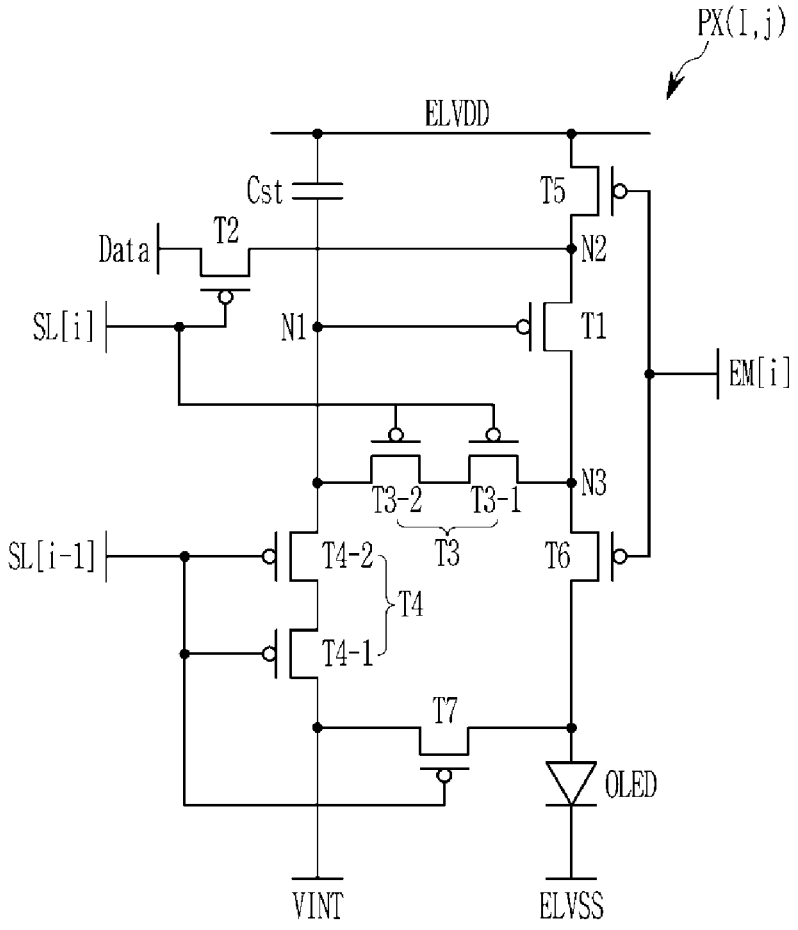
FIG. 2 illustrates a circuit diagram showing an example of a pixel in the display device of FIG. 1 according to one embodiment.

FIG. 2 illustrates a circuit diagram showing an example of a pixel PX in the display device 10 of FIG. 1 according to one embodiment.

The pixel PX disposed in an i-th row and a j-th column, (also referred to as pixel PX (i,j)) includes a plurality of T1, T2, T3-1, T3-2, T4-1, T4-2, T5, T6, and T7, a capacitor Cst, and an organic light emitting diode OLED that are selectively connected to each of the i-th scan line SLi to which an i-th scan signal SL[i] is supplied, an (i−1)-th scan line SL(i−1) to which an (i−1)-th scan signal SL[i−1] is supplied, an emission control line EMi to which an emission control signal EM[i] is supplied, a supply wire of the initialization voltage Vint, a data line DLj to which a data signal Data is supplied, and supply wires of the high and low power supply voltages ELVDD and ELVSS.

A gate of the first transistor T1 is connected to a drain of the third transistor T3, the drain of the fourth transistor T4-2, and a first electrode of the capacitor Cst at a first node N1, a source of the first transistor T1 is connected to a drain of the second transistor T2 and a drain of the fifth transistor T5 at a second node N2, and a drain of the first transistor T1 is connected to a source of the third transistor T3-1 and a source of the sixth transistor T6 at a third node N3.

A gate of the second transistor T2 is connected to the scan line SLi, a source of the second transistor T2 is connected to the data line DLj, and a drain of the second transistor T2 is connected to the source of the first transistor T1 at the second node N2.

A gate of the third transistor T3 is connected to the scan line SLi, a source of the third transistor T3 is connected to the drain of the first transistor T1 at the third node N3, and the drain of the third transistor T3 is connected to the gate of the first transistor T1 at the first node N1.

The third transistor T3 may be formed as double gate transistor including transistors T3-1 and T3-2. Gates of the third transistors T3-1 and T3-2 are connected to the scan line SLi, a source of the third transistor T3-1 is connected to the drain of the first transistor T1 and connected to an anode of an organic light emitting diode OLED via the sixth transistor T6 at the third node N3, and a drain of the third transistor T3-2 is connected to the first electrode of the capacitor Cst, a drain of the fourth transistor T4-2, and a gate of the first transistor T1 at the first node N1. In addition, a drain of the third transistor T3-1 and a source of the third transistor T3-2 may be connected to each other.

A gate of the fourth transistor T4 is connected to the (i−1)-th scan line SL(i−1), a source of the fourth transistor T4 is connected to the supply wire of the initialization voltage Vint, and a drain of the fourth transistor T4 is connected to the gate of the first transistor T1 at the first node N1.

The fourth transistor T4 may be formed as double gate transistor including transistors T4-1 and T4-2. A gate of the fourth transistor T4-1 is connected to the scan line SL(i−1), a drain of the fourth transistor T4-1 is connected to the supply wire of the initialization voltage Vint, and a source of the fourth transistor T4-1 is connected to a drain of the fourth transistor T4-2.

A gate of the fourth transistor T4-2 is connected to the scan line SL(i−1), the drain of the fourth transistor T4-2 is connected to the source of the fourth transistor T4-1, and a source of the fourth transistor T4-2 is connected to the first electrode of the capacitor Cst, the drain of the third transistor T3-2, and the gate of the first transistor T1 at the first node N1.

The fourth transistor T4 may be turned on according to the signal received through the scan line SL(i−1) to transfer the initialization voltage Vint to the gate of the first transistor T1, thereby performing an initialization operation for initializing a voltage of the gate of the first transistor T1.

A gate of the fifth transistor T5 is connected to the emission control line EMi, a source of the fifth transistor T5 is connected to the supply wire of the high power voltage ELVDD, and a drain of the fifth transistor T5 is connected to the source of the first transistor T1 at the second node N2.

A gate of the sixth transistor T6 is connected to the emission control line EMi, a source of the sixth transistor T6 is connected to the drain of the first transistor T1 at the third node N3, and a drain of the sixth transistor T6 is connected to the first electrode of the organic light emitting diode OLED. The first transistor T1 is connected to the organic light emitting diode OLED through the sixth transistor T6.

A gate of the seventh transistor T7 is connected to the scan line SL(i−1), a source of the seventh transistor T7 is connected to the first electrode of the organic light emitting diode OLED, and a drain of the seventh transistor T7 is connected to the drain of the fourth transistor T4 and the supply wire of the initialization voltage Vint.

The capacitor Cst has the first electrode that is connected to the gate of the first transistor T1 and the drain of the third transistor T3 at the first node N1, and a second electrode that is connected to the supply wire of the high power supply voltage ELVDD.

The organic light emitting diode OLED has the first electrode, a second electrode disposed on the first electrode, and an organic emission layer disposed between the first electrode and the second electrode. The first electrode of the organic light emitting diode OLED is connected to the source of the seventh transistor T7 and the drain of the sixth transistor T6, and the second electrode of the organic light emitting diode OLED is connected to the supply wire of the low power supply voltage ELVSS.

Figure 3A:
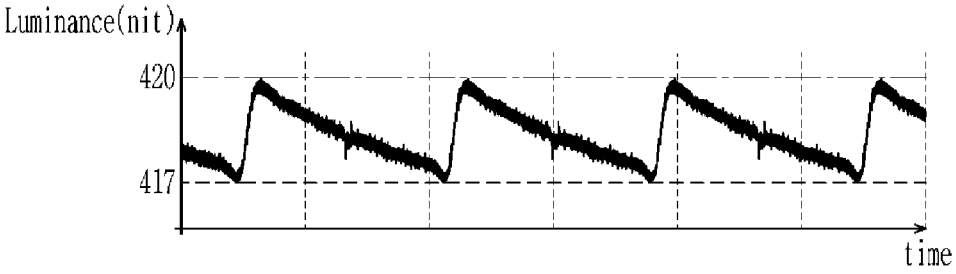
FIGS. 3A and 3B illustrate a graph showing a change in luminance depending on a driving frequency.
Figure 3B:
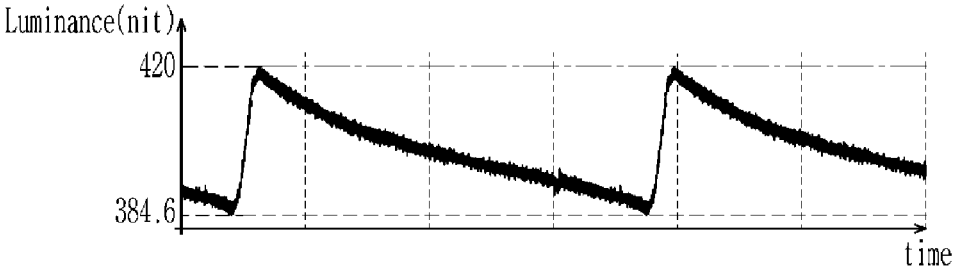

FIGS. 3A and 3B illustrate a graph showing a change in luminance depending on a driving frequency of the display device 10.

Specifically, FIG. 3A illustrates a graph showing luminance that changes in each frame when the driving frequency of the display device 10 is 60 Hz, and FIG. 3B illustrates a graph showing luminance that changes in each frame when the driving frequency of the display device 10 is 30 Hz.

As illustrated in FIG. 3B, when the driving frequency is low, that is, when an image is displayed on the display device 10 at 30 Hz, the luminance decreases by about 8.43% from 420 nit to 384.6 nit. In comparison, as illustrated in FIG. 3A, when the image is displayed on the display device 10 at 60 Hz, the luminance decreases by 0.71% from 420 nit to 417.

In the case of driving the display device 10 at the low driving frequency, e.g., 30 Hz compared to 60 Hz, one frame period is longer, so a driving current flowing through the first transistor T1 may change due to a leakage current of the third transistor T3 and the fourth transistor T4, thereby decreasing the luminance. Therefore, among two consecutive frames expressing a same luminance, a difference between the luminance at the end of a preceding frame and the luminance at the start of a following frame may be large. Flicker caused by such a large difference in luminance may be visually recognized by a viewer.

The flicker phenomenon may be differently recognized by the viewer depending on colors even when the same luminance is expressed. Table 1 shows a flicker recognition index depending on colors, and the larger the flicker perception index, the more easily may the viewer recognize the flicker.

TABLE 1

| Luminance | Flicker recognition index by colors | | | | | | |
|---|---|---|---|---|---|---|---|
| (nit) | White | Red | Green | Blue | Yellow | Magenta | Cyan |
| 100 | 1.63 | 0.65 | 1.18 | 0.57 | 1.31 | 0.79 | 1.35 |
| 60 | 1.40 | 0.65 | 1.35 | 0.65 | 1.42 | 0.95 | 1.37 |
| 10 | 1.51 | 0.63 | 0.70 | 0.71 | 1.09 | 1.02 | 1.19 |
| 2 | 0.90 | 0.35 | 0.01 | 0.68 | 0.76 | 0.72 | 0.51 |

As shown in Table 1 above, it can be seen that the flicker recognition index differs depending on luminance and colors, and the flicker recognition characteristic is generally low in red and blue colors. The display device 10 may reduce recognition of flicker when it is driven at a low driving frequency by compensating the image data signal DATA with a color having a low flicker recognition characteristic depending on luminance by considering at least one of a representative gray value and a color for each area, a representative gray value and a color of an entire image in the image data of one frame.

Figure 4:
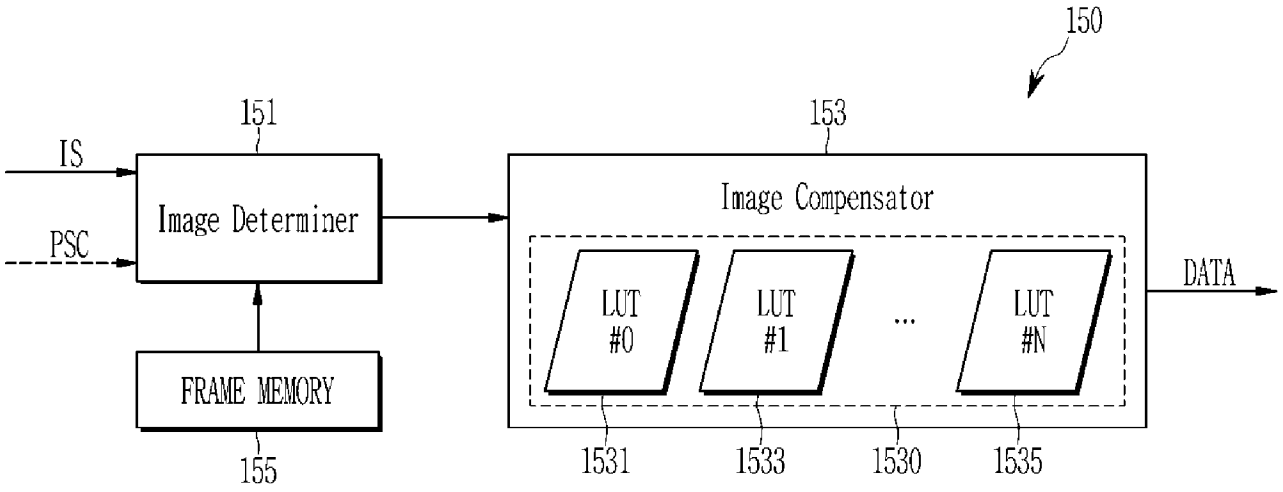
FIG. 4 illustrates a block diagram of a signal controller included in the display device of FIG. 1 according to one embodiment.

FIG. 4 illustrates a block diagram of the signal controller 150 included in the display device 10 of FIG. 1 according to one embodiment.

The signal controller 150 of the display device 10 includes an image determiner 151, an image compensator 153, and a frame memory 155.

The image determiner 151 receives the image signal IS. The image determiner 151 may determine whether the inputted image signal IS displays a still image or a motion picture (or a video). In an embodiment, the image determiner 151 may compare data of at least two frames of the input image signal IS to determine whether the input image signal IS is a still image signal or a motion picture signal. The image determiner 151 may store at least two frame data of the image signal IS in the frame memory 155, and may compare them to determine whether the image signal IS displays a still image or a motion picture. Herein, at least two frame data may be temporally adjacent (or consecutive) to each other. According to an embodiment, the image determiner 151 may determine that the image signal IS displays a still image when two same adjacent frame data are the same or the substantially the same in succession during a predetermined frame (time) or longer.

For example, the image determiner 151 may compare at least two temporally adjacent frame data among the frame data of the image signal IS. Specifically, the image determiner 151 may compare first data values (e.g., first data values of a specific region) included in the first frame data and second data values (e.g., second data values of the specific region) included in the second frame data. If a difference (or an amount of the difference) between the first data values and the second data values is smaller than or equal to a predetermined reference value, the image determiner 151 may determine that the input image signal IS is a still image signal, and if the difference exceeds the predetermined reference value, the image determiner 151 may determine that the input image signal IS is a motion picture signal.

As another example, the image determiner 151 may compare data values of some regions within at least two temporally adjacent frame data among the frame data of the image signal IS. For example, the image determiner 151 may compare data values of one or more arbitrary regions corresponding to each other within the first and second frame data. Specifically, the image determiner 151 may compare first data values corresponding to a specific region among the first frame data and second data values corresponding to the specific region among the second frame data. If a difference (or an amount of the difference) between the first data values and the second data values is smaller than or equal to a predetermined reference value, the image determiner 151 may determine that the specific region of the input image signal IS displays a still image, and if the difference exceeds the predetermined reference value, the image determiner 151 may determine that the specific region of the input video signal IS displays a motion picture signal.

According to one embodiment, in response to the PSR control signal PSC, the image determiner 151 may determine that a PSR mode section is started based on a PSR start signal included in the PSR control signal PSC, and may determine that the received input image signal IS is a still image signal. The image determiner 151 may store frame data of the input image signal IS received when the PSR start signal is received in the frame memory 155.

The image determiner 151 may determine a driving frequency for displaying an image of one frame when the image signal IS or a region thereof is determined to display a still image. For example, the image determiner 151 may determine the driving frequency based on a period during which a data enable signal DE is inputted. The image determiner 151 may also determine the driving frequency in consideration of a period during which a still image is maintained (e.g., a period from which the still image is started and until the still image is converted). The image determiner 151 may determine the driving frequency so that an image of one frame is displayed with a lower driving frequency as the period during which the still image is maintained is longer. In this case, the driving frequency (also referred to as a low driving frequency) may be 60 Hz or less, for example, 30 Hz, 20 Hz, 15 Hz, or 10 Hz.

The image determiner 151 may use gray values of the pixels in image data of one frame of the image signal IS to calculate at least one of a representative gray value for each pixel of the image data of one frame, a representative gray value for each area of the image data of one frame, and a representative gray value of the image data of one frame.

For example, the image determiner 151 may calculate a representative gray value of one pixel as follows.

$$\text{Gray}_{px}=a*R+b*G+c*B \quad \text{(Equation 1)}$$

Herein, R, G, and B may respectively indicate gray values of red, green, and blue (R, G, and B) of the corresponding pixel, while a, b, and c are constants, and a color with a higher flicker recognition index may have a greater representative gray value. In Equation 1, red, green, and blue R, G, and B values have been described as an example, but cyan, magenta, yellow, and black (CMYK) values may be used. It is understood that the present disclosure is not limited to these examples.

The image determiner 151 may divide the image data into a plurality of regions, and may calculate an average representative gray value of pixels included in each of the regions. For example, the image determiner 151 may calculate an average representative gray value of all pixels included in the image data.

The image compensator 153 may compensate the image data received from the image determiner 151 to display color coordinates corresponding to the determined driving frequency and the representative gray value. For example, the image compensator 153 may include a predetermined compensation look-up table (LUT) 1530 based on a physical characteristic of the display panel 100. The image compensator 153 may compensate the image data by referring to the compensation LUT 1530. The compensation LUT 1530 includes a plurality of LUTs 1531, 1533, and 1535 corresponding to the representative gray value and the driving frequency. Even though the image compensator 153 may have the same representative gray value, the image compensator 153 may compensate the image data by reading a different LUT based on the driving frequency.

Figure 6:
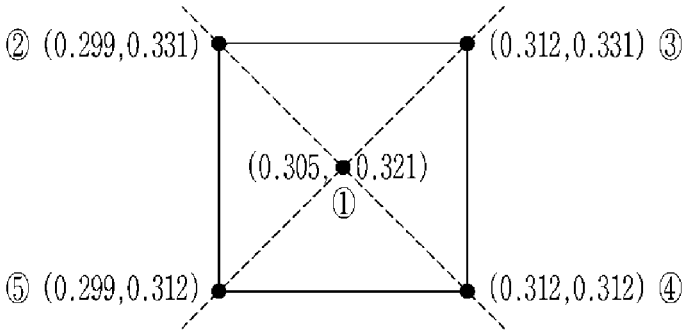
FIG. 6 illustrates an example of color coordinates.

FIG. 5 shows a look-up table (LUT) stored in the display device 10 according to an embodiment, and FIG. 6 illustrates an example of color coordinates.

The image compensator 153 of FIG. 4 may read an LUT according to color coordinates corresponding to the representative gray value of a pixel, and may compensate the grayscale value of the image data accordingly. For example, as illustrated in FIG. 6, in a case where the color coordinates of the display device 10 are 0.305 and 0.321 (①), and the representative gray value is 223, the color coordinates may be moved to 0.299 and 0.312 (⑤) referring to the LUT of FIG. 5. To this end, the image compensator 153 may compensate a gray value of the image data using a compensation value stored in the LUT. The compensation value depending on the color coordinates may be different according to a physical characteristic of the display panel 100. In addition, one LUT stores one or more compensation values corresponding to a plurality of gray values.

Each LUT may have a compensation value corresponding to the representative gray value and the driving frequency. In FIG. 5, when the representative gray values are 191 to 255, the image compensator 153 applies the compensation value stored in LUT #1 (1531 in FIG. 4), but when the driving frequencies are different, the image compensator 153 may apply a compensation value stored in another LUT even when they have a same representative gray value.

Referring back to FIG. 4, the image compensator 153 may output the compensated image data DATA to the data driver 120.

In FIG. 4, the image determiner 151 and the frame memory 155 are shown to be included in the signal controller 150, but the image determiner 151 and the frame memory 155 may be included in a different element, for example, the application processor 160. In this case, steps S100, S110, S120, and S130 in FIG. 7 to be described below may be performed by the application processor 160.

Figure 7:
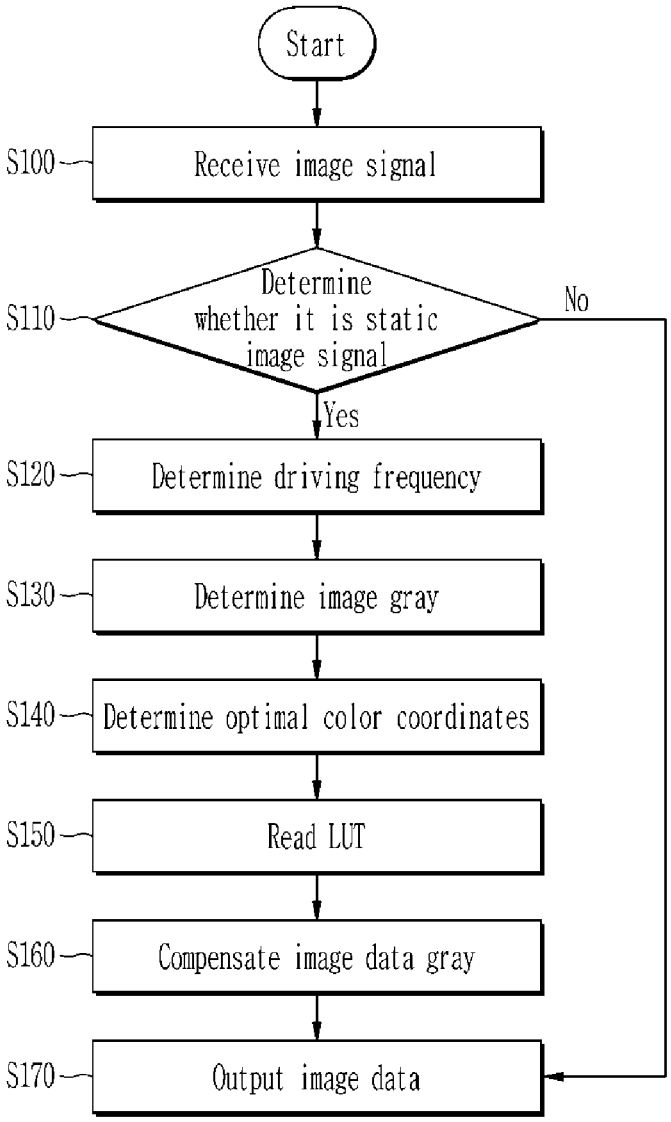
FIG. 7 is a flowchart showing a driving method of a display device according to an embodiment.

FIG. 7 is a flowchart showing a driving method of the display device 10 according to an embodiment.

The image determiner 151 of FIG. 4 receives an image signal IS (S100).

Next, the image determiner 151 determines whether the inputted image signal IS displays a still image or a motion picture (S110).

If the image determiner 151 determines that the image signal IS or a region thereof displays a still image, the image determiner 151 determines a driving frequency for displaying an image of one frame (S120). If the image determiner 151 determines that the image signal IS or a region thereof displays a motion picture, the image compensator 153 may output the image data DATA to the data driver 120 without compensating the image data DATA (S170). The image determiner 151 may compare data of at least two frames of the input image signal IS to determine whether the input image signal IS is a still image signal or a motion picture signal. Alternatively, the image determiner 151 may receive the PSR control signal PSC and determine that a PSR mode section is started based on a PSR start signal included in the PSR control signal PSC, and may determine that the received input image signal IS is a still image signal.

Next, the image determiner 151 may use gray values of pixels in image data of one frame of the image signal IS and calculate at least one of a representative gray value for each pixel, a representative gray value for each area, and a representative gray value for the entire image (S130). The image determiner 151 may calculate a representative gray value using the gray values and weight values of red, green, blue R, G, and B of pixels.

The image compensator 153 may determinate color coordinates corresponding to the driving frequency that is determined in S120 and the representative gray value that is calculated in S130 (S140).

The image compensator 153 may look up the compensation LUT 1530 based on the corresponding color coordinates (S150).

The image compensator 153 may compensate the image data using the compensation value stored in the compensation LUT 1530 (S160).

The image compensator 153 may output the compensated image data DATA to the data driver 120 (S170).

As described above, the display device 10 may reduce recognition of flicker when it is driven at a low driving frequency by compensating the image data DATA with a color having a low flicker recognition characteristic based on luminance by considering at least one of a representative gray value and a color for each area, and a representative gray value and a color of an entire image in the image data of one frame.

While the present disclosure has been described in connection with some embodiments, it is to be understood that the present disclosure is not limited to the disclosed embodiments, but, on the contrary, is intended to cover various modifications and equivalent arrangements included within the spirit and scope of the present disclosure including the appended claims.

What is claimed is:

1. A display device comprising:

a display panel comprising a plurality of pixels and configured to display an image;

a signal controller configured to determine whether an input image signal is a still image signal, determine color coordinates using data values of one frame data of the input image signal, and generate compensated image data by compensating image data of the one frame data based on the color coordinates; and a data driver configured to generate a data signal based on the compensated image data and output the compensated image data to the display panel through a data line, wherein the signal controller includes an image determiner configured to compare at least two frame data of the input image signal to determine whether the input image signal is the still image signal, and wherein the image determiner calculates at least one of a first representative gray value for each pixel of the plurality of pixels, a second representative gray value for each area of a plurality of areas in the one frame data, and a third representative gray value of the image, using gray values of the plurality of pixels in the one frame data based on determination that the input image signal is the still image signal.

2. The display device of claim 1, wherein the image determiner determines a driving frequency at which the one frame data is displayed based on determination that the input image signal is the still image signal.

3. The display device of claim 2, wherein the signal controller further includes an image compensator configured to generate the compensated image data depending on at least one of the driving frequency, the first representative gray value for the each pixel of the plurality of pixels, the second representative gray value for the each area of the plurality of areas in the one frame data, and the third representative gray value of the image.

4. The display device of claim 3, wherein the image compensator compensates the image data depending on the one frame data using compensation data stored in a look-up table (LUT).

5. The display device of claim 2, wherein the driving frequency is lower than 60 Hz.

6. The display device of claim 1, wherein the image determiner receives a panel self refresh (PSR) control signal for controlling a PSR mode in which the display panel displays a still image together with the input image signal, and determines whether the input image signal is the still image signal based on the PSR control signal.

7. The display device of claim 1, wherein each of the plurality of pixels includes:

a first transistor connected to the data line and providing the data signal based on a scan signal received through a scan line;

a capacitor connected to the first transistor and configured to store a voltage corresponding to the data signal; and a second transistor providing a driving current based on the voltage.

8. A driving method of a display device, comprising:

determining whether an input image signal is a still image signal;

based on determination that the input image signal is the still image signal, calculating a representative gray value including at least one of a first representative gray value for each pixel of a plurality of pixels, a second representative gray value for each area of a plurality of areas in one frame data, and a third representative gray value of an image, using gray values of the plurality of pixels in the one frame data of the input image signal based on determination that the input image signal is the still image signal, determining color coordinates using the representative gray value, and generating compensated image data by compensating image data of the one frame data based on the color coordinates; and generating a data signal based on the compensated image data and outputting the compensated image data to a display panel through a data line.

9. The driving method of claim 8, wherein the determining whether the input image signal is the still image signal comprises comparing at least two frame data of the input image signal to determine whether the input image signal is the still image signal.

10. The driving method of claim 9, further comprising:

determining a driving frequency at which the one frame data is displayed based on determination that the input image signal is the still image signal.

11. The driving method of claim 10, further comprising:

generating the compensated image data depending on at least one of the driving frequency, the first representative gray value for the each pixel of the plurality of pixels, the second representative gray value for the each area of the plurality of areas in the one frame data, and the third representative gray value of the image.

12. The driving method of claim 11, wherein the compensated image data is generated based on compensation data stored in a look-up table (LUT).

13. The driving method of claim 10, wherein the driving frequency is lower than 60 Hz.

14. The driving method of claim 9, wherein the determining of whether the input image signal is the still image signal comprises:

receiving a panel self refresh (PSR) control signal for controlling a PSR mode displaying a still image together with the input image signal; and determining whether the input image signal is the still image signal based on the PSR control signal.

* * * * *